US006546678B1

(12) United States Patent
Ashton et al.

(10) Patent No.: US 6,546,678 B1
(45) Date of Patent: Apr. 15, 2003

(54) MANUALLY ADJUSTABLE STRUCTURAL LOAD TRANSFERRING DEVICE

(75) Inventors: Roger Wall Ashton, Orinda, CA (US); Robert Donald Lucey, Lafayette, CA (US); John Duncan Pryor, Oakland, CA (US)

(73) Assignee: Zone Four LLC, San Leandro, CA (US)

( * ) Notice: Subject to any disclaimer, the term of this patent is extended or adjusted under 35 U.S.C. 154(b) by 126 days.

(21) Appl. No.: 09/695,205

(22) Filed: Oct. 24, 2000

Related U.S. Application Data

(63) Continuation of application No. 09/371,216, filed on Aug. 10, 1999, now Pat. No. 6,155,019, which is a continuation of application No. 09/084,752, filed on May 26, 1998, now Pat. No. 5,992,126, which is a continuation of application No. 08/517,728, filed on Aug. 21, 1995, now Pat. No. 5,809,719.

(51) Int. Cl.[7] ..... E04G 25/08
(52) U.S. Cl. ..... 52/167.3; 52/739.1
(58) Field of Search ..... 52/127.2, 223.11, 52/223.1, 223.7, 739.1, 730.1, 291, 167.3; 248/354.3

(56) References Cited

U.S. PATENT DOCUMENTS

| | | | | |
|---|---|---|---|---|
| 2,963,127 A | | 12/1960 | Manville | 52/693 |
| 2,967,726 A | | 1/1961 | Weston | 403/157 |
| 2,986,246 A | * | 5/1961 | Lester | 52/291 |
| 3,006,592 A | | 10/1961 | Davis, Jr. | 248/354.3 |
| 3,700,202 A | | 10/1972 | Donnels | 248/354.3 X |
| 3,850,533 A | | 11/1974 | Thielen | 403/157 X |
| 4,173,857 A | | 11/1979 | Kosaka | |
| 4,188,681 A | | 2/1980 | Tada et al. | |
| 4,304,078 A | | 12/1981 | Meriwether, Jr. | 248/354.3 X |
| 4,463,923 A | | 8/1984 | Reiker | |
| 4,518,141 A | | 5/1985 | Parkin | |
| 4,682,452 A | | 7/1987 | Propp et al. | |
| 4,776,729 A | | 10/1988 | Seegmiller | |
| 4,783,119 A | | 11/1988 | Moses | 403/84 X |
| 4,808,023 A | | 2/1989 | Arnold et al. | 403/79 X |
| 4,872,634 A | | 10/1989 | Gillaspy et al. | 248/354.3 |
| 5,056,952 A | | 10/1991 | Gringer | 403/103 X |
| 5,214,900 A | | 6/1993 | Folkerts | |
| 5,253,839 A | | 10/1993 | McClure | 52/127.2 |
| 5,458,647 A | | 10/1995 | Brochier et al. | 403/157 X |
| 5,491,935 A | | 2/1996 | Coxum | 52/223.1 X |

FOREIGN PATENT DOCUMENTS

| | | | |
|---|---|---|---|
| CA | 2063095 | 9/1993 | 52/127.2 |
| DE | 1500838 | 11/1969 | 403/262 |
| FR | 1310595 | 10/1962 | 248/354.3 |
| GB | 721394 | 1/1955 | 52/127.2 |
| JP | 5-272232 | 10/1993 | |

* cited by examiner

*Primary Examiner*—Michael Safavi
(74) *Attorney, Agent, or Firm*—Knobbe, Martens, Olson & Bear LLC

(57) ABSTRACT

A manually adjustable structural load transferring device and system for providing tension and compression force transfer between a plurality of spaced building structural members. A pair of load transfer members are each provided with a threaded first end and a second end, the threaded first end of one of the pair of members having threads of opposite pitch to those of the first end of the other one. A coupler member has first and second threaded ends engaged with the threaded first ends of the pair of load transfer members so that the length of the assembly can be adjusted by relative rotation between the coupler member and the load transfer members. An end connection device is attached to the second end of each of the load transfer members, the end connection device including a plurality of fastener apertures and a plurality of bolt apertures for securing the base plate to a building structural member. The load transferring device is manually adjusted to fit the space between adjacent building structural members, and is secured to such structural members by fasteners and bolts.

6 Claims, 8 Drawing Sheets

FIG. 17
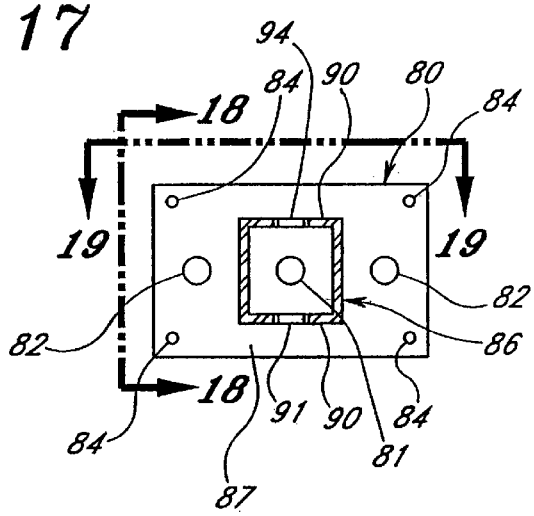
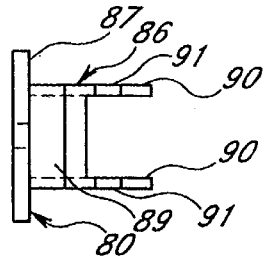
FIG. 18
FIG. 19
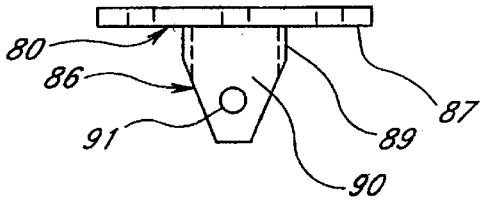
FIG. 20
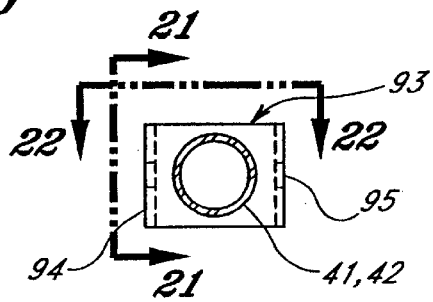
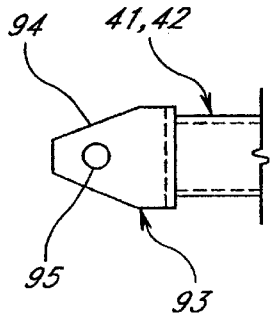
FIG. 21
FIG. 22
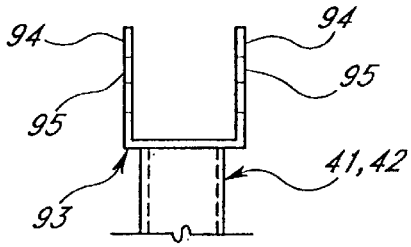

FIG.23
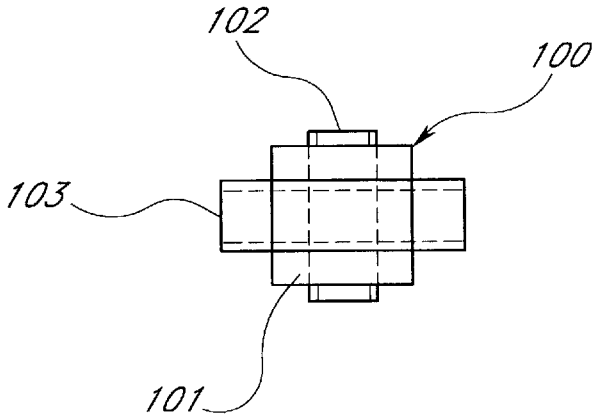
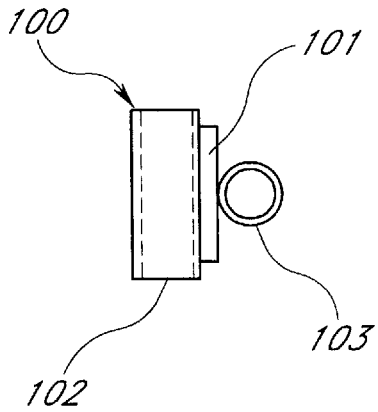
FIG.24
FIG.25
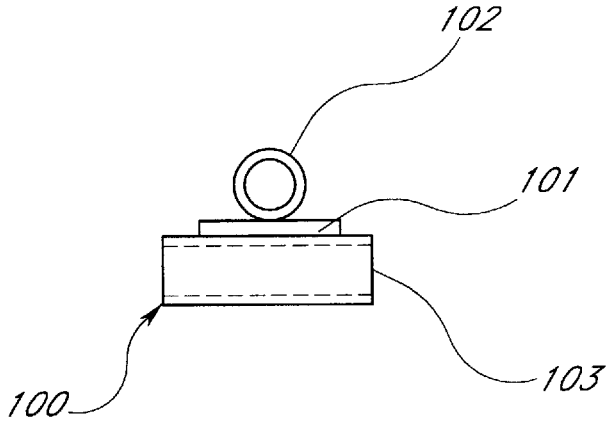

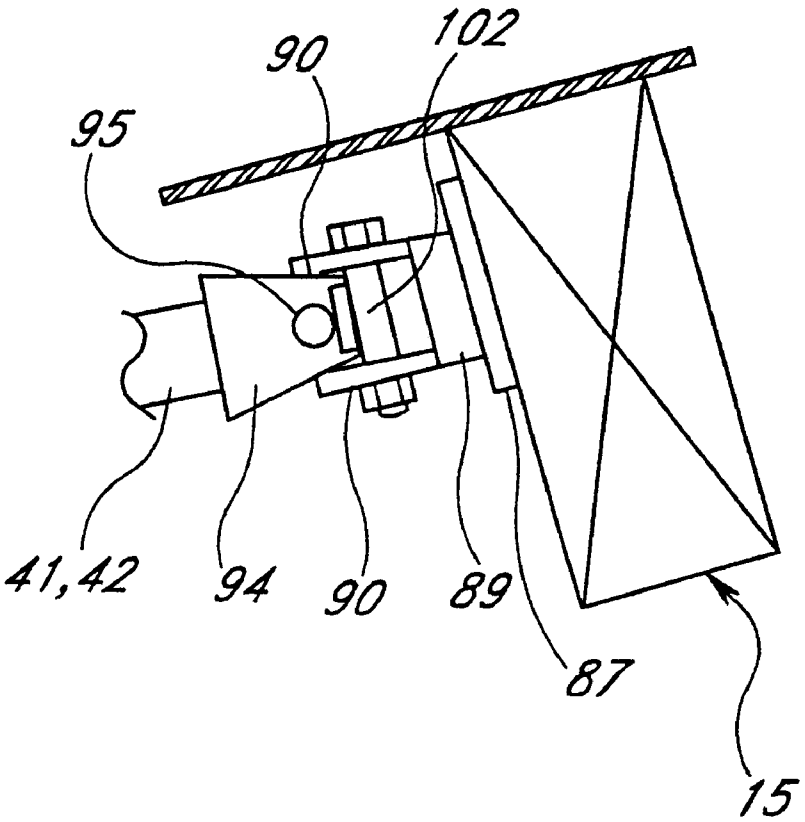
FIG. Y
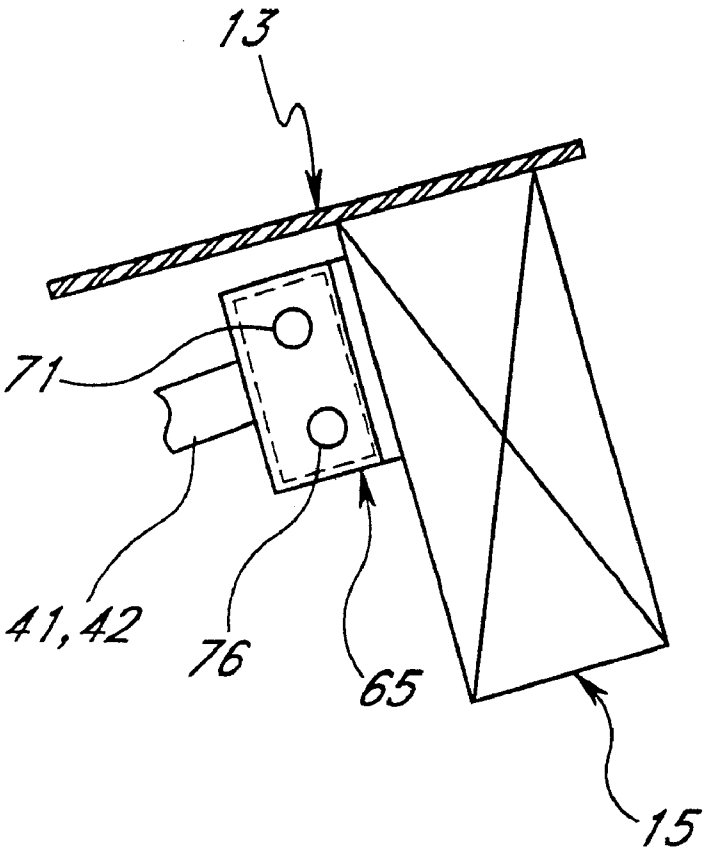
FIG. X

MANUALLY ADJUSTABLE STRUCTURAL LOAD TRANSFERRING DEVICE

The present application is a continuation of application Ser. No. 09/371,216, filed Aug. 10, 1999, now U.S. Pat. No. 6,155,019 which is a continuation of application Ser. No. 09/084,752, filed May 26, 1998, issued as U.S. Pat. No. 5,992,126 on Nov. 30, 1999, which is a continuation of application Ser. No. 08/517,728, filed Aug. 21, 1995, issued as U.S. Pat. No. 5,809,719 on Sep. 22, 1998.

BACKGROUND OF THE INVENTION

1. Field of the Invention

This invention relates to devices used to interconnect the structural members of a building for the purpose of transferring forces between the structural members of a building, such as the wall of a building and the floor and/or roof framing systems.

2. Description of the Prior Art

Buildings can be subjected to excessive natural or abnormal forces (seismic, wind, blast, etc.) with disastrous consequences. Investigations have found that "tilt-up" buildings, especially older buildings with timber framed roof framing systems, are vulnerable to damage and/or collapse during earthquakes. Tilt-up buildings typically consist of a structure that is constructed with concrete wall panels that are precast horizontally on the ground, and after curing, tilted up into place.

Numerous tilt-up buildings are constructed with timber roof framing systems. One common type of timber roof framing system is referred to as a "panelized" system, and typically consists of longspan glulam beams, timber purlins, timber joists, and roof sheathing. The roof sheathing typically consists of 4'×8" sheets of plywood, and spans between the joists. The joists typically consist of 2×4's or 2×6's and span between the purlins. The purlins typically consist of 4×12's or 4×14's and span between the glulam beams. The plywood sheathing is typically oriented with the long dimension parallel to the joists, or perpendicular to the purlins. The joists are typically spaced 2 feet apart. The purlins are typically spaced 8 feet apart to accommodate the length of the plywood sheathing. The glulam beams are typically spaced 20 to 24 feet apart. Sections of the panelized roof are typically fabricated on the ground and raised into place with a crane or forklift. For installation purposes the joists and purlins are typically cut short to allow for field variations in the dimension between purlins and glulam beams.

In areas subject to high seismicity the connections between the concrete wall panels of many tilt-up buildings and the timber roof framing systems are commonly deficient when gauged by the currently established seismic design standards and/or recommendations for such buildings, and may present for the potential of a partial or complete collapse of the building during an earthquake. More particularly, in many older tilt-up type buildings this connection typically consists of only the nailing between the roof sheathing and the timber ledger that is bolted to the wall panel. When the wall panels try to separate from the roof diaphragm and roof framing system during an earthquake, this type of connection will typically subject the ledgers to "cross grain bending", a mechanism which is highly vulnerable to failure, and may allow for the potential of a partial or complete collapse of the building. This type of connection has been specifically disallowed since adoption of the 1973 edition of the Uniform Building Code.

It is generally recommended that tilt-up buildings with such deficiencies be retrofitted with new connections per the currently established seismic design standards and/or recommendations for such buildings. For tilt-up buildings with panelized roof framing systems, a common method of installing retrofit structural elements for the purposes of connecting the wall panels of these buildings to the roof diaphragms, for those wall panels oriented perpendicular to the joists or parallel to the purlins, consists of installing a series of timber struts that extend from the wall panel into the roof diaphragm. These struts are attached to the wall panels and interconnected with each other (across intercedding purlins) with a variety of steel connection devices (plates, bent plates, holdowns, bolts, etc.). These connection devices are generally attached to the struts in an eccentric manner, but may be connected to the struts in a concentric manner. In some installations these steel connection devices include rods acting in tension and extending the full length of the struts. This assemblage of timber struts and connection devices and/or rods is referred to as a "dragline".

There are a number of potential problems associated with the above described retrofit installation of draglines. The steel connection devices used to interconnect the struts of a dragline are subject to improper installation, especially when a dragline is installed in a difficult location. In such situations the connection devices are prone to being improperly located, or aligned, and the bolt holes for the connection devices are prone to being oversized.

Ideally, the timber struts of a dragline should each be sized on an individual basis to fit precisely and tightly between two adjacent purlins, or between a purlin and a ledger. In practice, however, these struts are generally cut short to facilitate and expedite installation, and unless adequate shimming is provided at the end bearings of the timber struts, such practices provide for a poor overall dragline installation. In general, the proper installation of timber struts is relatively labor intensive and costly, especially when the strut ends must be cut at skewed angles to match existing conditions, or installed in difficult locations.

Ideally, draglines should be installed with nailing between the timber struts and the roof diaphragm (plywood sheathing). Such installations provide for a direct transfer of the seismic loads generated by a wall panel to the roof diaphragm during an earthquake. Typically, due to the costs and potential leakage problems associated with the removal and replacement of roofing, the nailing between the roof diaphragm and the timber struts is often omitted.

When draglines are installed without any nailing between the roof diaphragm and the timber struts, the seismic loads generated by a wall panel during an earthquake are transferred to the roof diaphragm via mobilization of the nailing between the roof diaphragm and the purlins connected to the draglines. In order to properly transfer these loads through the dragline, the end bearings of the timber struts must be tight. If the timber struts have been cut short and the end bearings have not been shimmed tight, then the purlins may be subjected to rotation, and the nailing between the roof diaphragm and the purlins may be subjected to unintended forces. This condition may potentially degrade the capacity of the purlins, as well as degrade the capacity of the nailing between the roof diaphragm and the purlins.

In practice, the timber struts of a dragline are frequently cut short, the end bearings are not shimmed tight, and the timber struts are not nailed to the diaphragm, resulting in a dragline installation that may not provide for the adequate transfer of seismic forces between a wall panel and a roof diaphragm.

Even if the timber struts are initially installed with tight end bearings, it is frequently the case that the timber struts are installed "green" and later shrink, leaving a gap at the end bearings, as they dry out. This can be avoided by using timber struts that have been pre-dried (kiln dried), or are non-shrink (Parallams), however the cost of these materials is significantly greater than that of green timber.

Typically, draglines are only designed for tension loads, and the struts are interconnected eccentrically. Recent investigations and studies of earthquake damaged tilt-up type buildings have recommended that draglines be designed for both tension and compression forces, and interconnected concentrically. Such recommendations intend to provide for a positive means of transferring the compression loads generated by a wall panel during an earthquake to the roof diaphragm, and eliminate problems associated with eccentric interconnections. The installation of concentric interconnections, and interconnections that are capable of resisting compression loads, incurs additional costs due to added steel connection devices, added shimming of strut end bearings, and added installation time.

In summary, the above described dragline installation is difficult to install, labor intensive, costly, and the installed quality is subject to significant variation.

In practice, draglines are typically installed without any nailing between the roof diaphragm and the timber struts. For this condition the seismic tension loads generated by a wall panel during an earthquake are transferred to the roof diaphragm by mobilizing the nailing between the roof diaphragm and the purlins attached to the dragline, and the roof joists adjacent to the dragline. In order to properly transfer these loads through the dragline, the end bearings between the timber struts of the dragline and the purlins must be tight, or must be shimmed tight.

Generally, the end connections used to secure the timber struts to the purlins or ledgers are inadequate in resisting and transferring the seismic design forces associated with a dragline. Unless the end bearings between the timber struts of the dragline and the purlins, as well as the end bearings between the roof joists and the purlins, are tight, or have been shimmed tight, the purlins may be subjected to unintended rotation and the nailing between the roof diaphragm and purlins may be subjected to unintended forces, and thus potentially degrade the capacity of the purlins, as well as degrade the capacity of the nailing between the roof diaphragm and the purlins.

SUMMARY OF THE INVENTION

She invention comprises a system and method for improving the transfer of compression and tension forces between and through the structural members and elements of a building which is relatively simple and quick to install, requires no special expertise or tools, which is readily adaptable to many different building structural element configurations and which provides a precision, high quality installation.

From a system standpoint, the invention comprises a plurality of manually adjustable serially connected load transferring devices each secured to a spaced pair of building structural elements, with at least some of the load transferring devices being attached to opposite surfaces of the same building structural element in mutual alignment so that tension and compression forces are transferred along the load transferring devices and through the attached and intervening building structural elements. Each load transferring device comprises a pair of load transfer members each having a threaded first end and a second end, the first end of each of the pair of load transfer members having threads of opposite pitch to those of the first end of the other one of the pair of load transfer members. A coupler member having first and second threaded ends is engaged with the threaded first ends of each of the pair of load transfer members. The threaded first ends of the pair of load transfer members may have either external or internal threads, and the first and second threaded ends of the coupler member are complementarily configured with either internal or external threads, respectively.

Each load transferring device further includes a pair of end connection devices each attached to the second end of a different one of the plurality of load transfer members, with each end connection device having a base plate and means for connecting the base plate to the second end of the associated load transfer member. The base plate is provided with a first plurality of fastener apertures and a second plurality of bolt apertures which are usually larger than the fastener apertures for respectively receiving fasteners and bolts for securing the base plate to a building structural member. The means for connecting may comprise any number of different embodiments, depending on the requirements of a particular application. In the first embodiment, the means for connecting includes a fixed structural connection between the base plate and the second end of the associated load transfer member so that the base plate and load transfer member are rigidly connected. In another embodiment which provides articulation in a single plane, the means for connection includes a first pair of spaced connector plates extending from the base plate, with each connector plate having a pivot bolt aperture, a pair of spaced connector legs secured to the second end of the associated load transfer member, with each connector leg having a pivot bolt aperture. The relative spacing between the connector plates and the connector legs is selected to enable one pair to be received within the other pair. A pivot bolt is received within the pivot bolt apertures once the pair of connector plates and connector legs are aligned in order to provide the articulating connection.

In another alternate embodiment providing articulation in a single plane, the means for connecting includes a pair of spaced connector plates extending from the base plate, with each connector plate having a pivot bolt aperture, and a pivot bolt. In this embodiment, the second end of the load transfer member includes a pivot hole formed therein so that the pivot bolt can be passed through the pivot bolt apertures and the pivot hole when the connecting means is aligned with the second end of the load transfer member.

In still another embodiment providing the combination of articulation in one plane and a lock-in feature, one of the pair of connector plates and connector legs is provided with a lock-in aperture to serve as a pilot hole for forming a lock-in aperture in the other one of a pair of connector plates and connector legs and also to serve as an aperture for receiving a lock bolt after assembly.

In another embodiment providing articulation in two different planes, the means for connecting includes a pivot connector piece having a first pivot guide for alignment with the connector plate pivot bolt aperture and a second pivot guide for alignment with the connector leg pivot bolt aperture, the first and second pivot guides being arranged at an angle with each other to provide two-axis articulating connection.

The system is installed between adjacent structural elements of a building on an individual basis, with each load transferring device being initially assembled and then adjusted in length by rotating the coupler until the base plates of the end connection devices encounter the facing surfaces of the building structural elements. Thereafter, the base plates are fastened to the structural element using suitable fasteners, such as nails or screws, and the bolt holes in the base plates are used as templates for forming through apertures in the structural elements, typically by drilling. Finally, mounting bolts are passed through the bolt holes and apertures and secured in place with nuts and thrust washers or plates. Load transferring devices secured to opposite sides of a building structural element are coupled together using a single set of bolts, thereby assuring axial alignment of the load transferring devices without the necessity for any special measurements or fixtures.

The invention provides a relatively low cost and simple solution to the problem of improving the transfer of both compression and tension forces through and between the structural elements of a building, in order to improve the response of the building to external forces associated with earthquakes, wind, blasts, severe storms and the like.

For a fuller understanding of the nature and advantages of the invention, reference should be had to ensuing detailed description taken in conjunction with the accompanying drawings.

BRIEF DESCRIPTION OF THE DRAWINGS

FIGS. 17–19 are a top plan view, side sectional view and front sectional view, respectively, of the connector plate portion of another embodiment of the end connection device providing articulation in two different planes;

FIGS. 20–22 are a top plan view, side sectional view and front sectional view, respectively, of the U-plate portion of the double articulated embodiment;

FIGS. 23–25 are a top plan view, side view and front edge view, respectively, of the pivotal connector piece of the double articulating end connection device embodiment.

FIG. X is a side view illustrating the lock-in feature of FIGS. 11–16 with respect to a building structural member and a load transfer member; and FIG. Y is a side view illustrating the double articulating embodiment of FIGS. 17–25 with respect to a building structural member and a load transfer member.

DETAILED DESCRIPTION OF THE PREFERRED EMBODIMENTS

Figure 1:
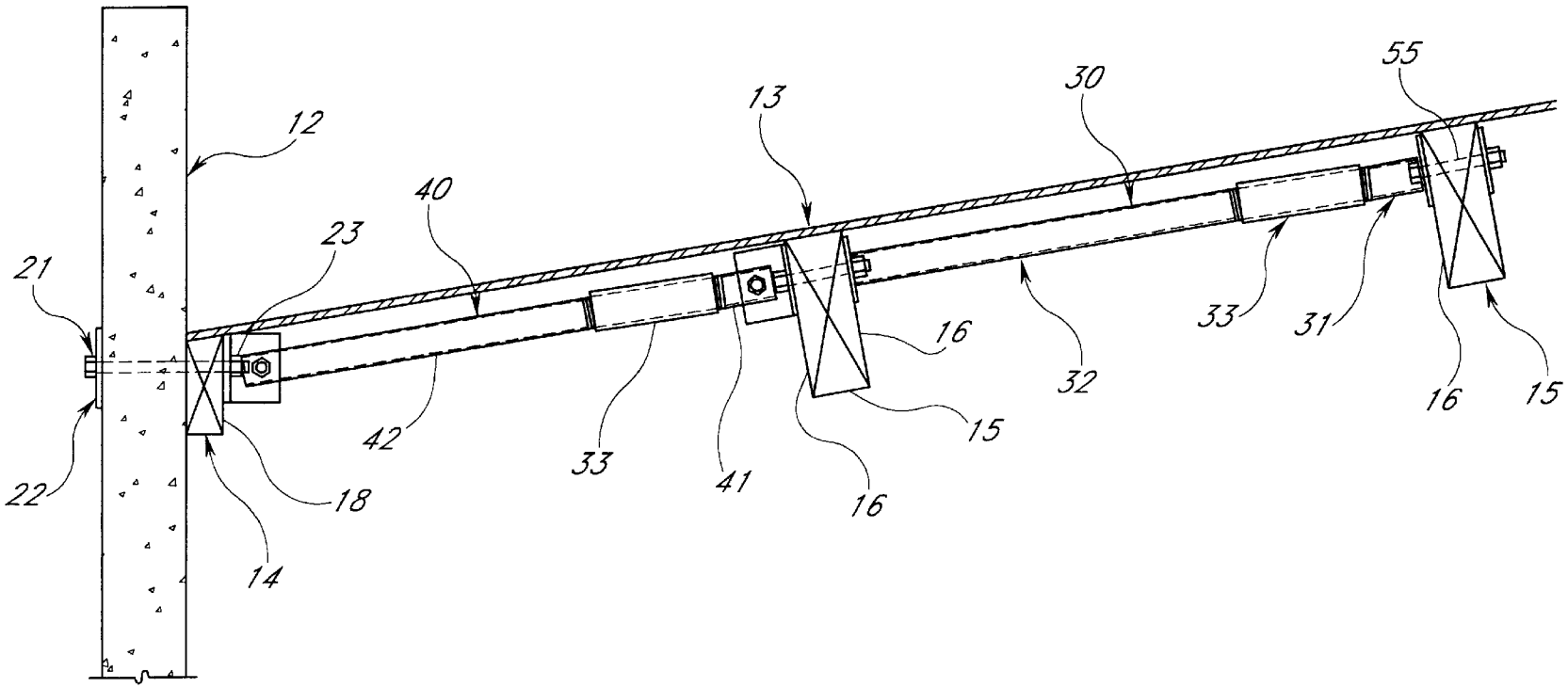
FIG. 1 is a schematic view of two embodiments of the invention installed in a building structure.

Turning now to the drawings, FIG. 1 illustrates two embodiments of the invention installed in a building structure including a vertical wall 12 (such as a concrete wall panel) and a roof diaphragm and framing system 13. System 13 may comprise any suitable roofing structure, such as a plurality of plywood sheets, which are structurally connected to a support beam 14 (commonly termed a ledger) and a plurality of support members 15 (commonly termed purlins). As can be seen in FIG. 1, purlins 15 are mounted in such a manner as to provide parallel confronting side surfaces 16. In addition, roof element 13 is mounted at an angle with respect to wall panel 12 so that the inner side surface 18 of ledger 14 resides at an angle with respect to the confronting side surface 16 of adjacent purlin 15. Roof element 13 is adhered to the top of ledger 14 and purlins 15 by any suitable means, such as nail or screw fasteners (not shown). Ledger 14 is secured to wall panel 12 by means of a plurality of originally installed bolts (not shown).

In order to provide a load transfer between wall panel 12 and purlins 15, load transfer devices incorporating the invention are employed. FIG. 1 illustrates two different embodiments of the invention: a first embodiment generally designated with reference numeral 30 provided with non-articulating end connection devices, and a second embodiment generally designated with reference numeral 40 provided with end connection devices which articulate in a single plane.

Figure 2:
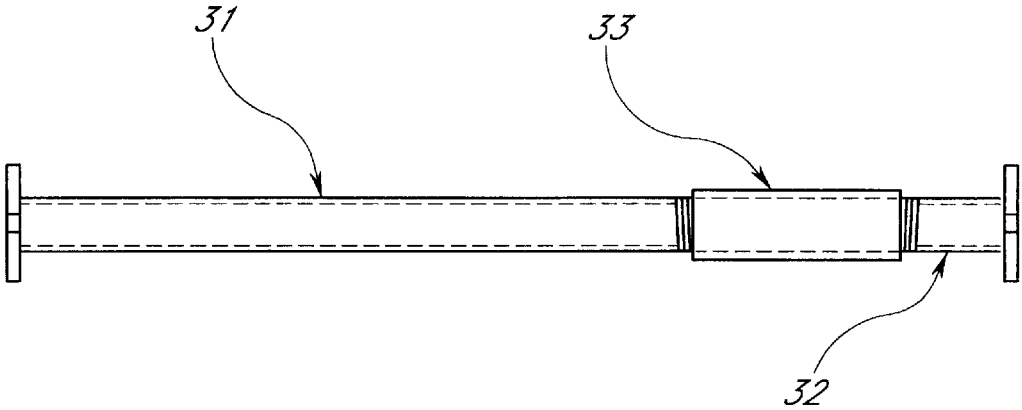
FIG. 2 is an enlarged detailed view showing the coupler and a pair of pipe members.
Figure 3:
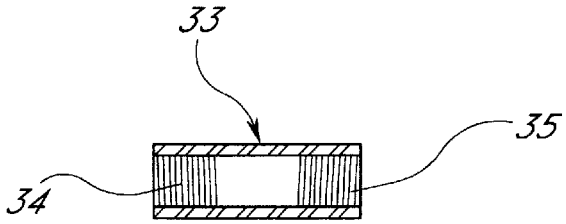
FIG. 3 is a sectional view of the coupler.
Figure 4:
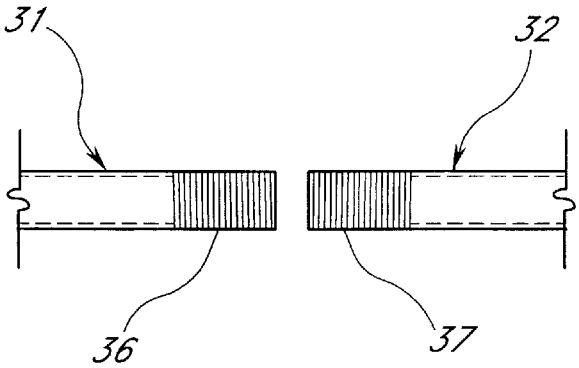
FIG. 4 is an elevational view of the proximate end of each of the pipe members.

With reference to FIG. 2, all embodiments of the invention share in common a pair of pipe elements 31, 32 adjustably connected by means of a coupler 33. As seen in FIG. 3, coupler 33 is internally threaded at the opposite ends thereof, with the threads 34 at one end having opposite pitch to the threads at the other end 35. The confronting ends of pipe elements 31, 32 are threaded in the same pitch as the internal threads provided in coupler 33: i.e., the threads at end 36 of pipe element 31 are threaded in the same pitch as the threads at end 34 of coupler 33; while the threads at end 37 of pipe element 32 are threaded in the same pitch as the threads at end 35 of coupler 33. Consequently, with pipe elements 31, 32 secured against rotation, rotation of coupler 33 in one direction will cause expansion along the axis of the device, while rotation of coupler 33 in the opposite direction will cause contraction of the device along the axis thereof.

Each embodiment of the invention includes end connection devices secured to the distal end of each pipe element (i.e., the end remote from the coupler 33). In general, the end connection devices are either fixed and non-articulating (the embodiment shown in FIGS. 5–7); provide articulation in a single plane (the embodiment of FIGS. 8–16); or provide articulation in two different planes (the embodiments of FIGS. 20–25).

Figure 5:
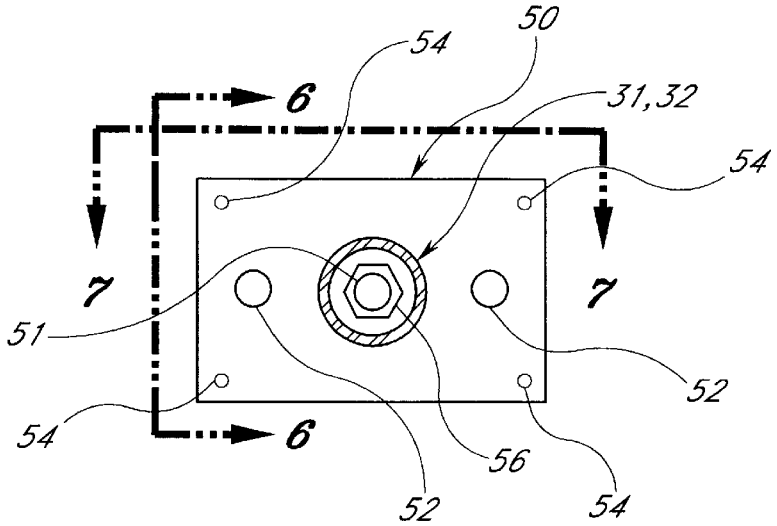
FIGS. 5–7 are a top plan view, side view and edge view, respectively, of a first embodiment of the end connection device.
Figure 6:
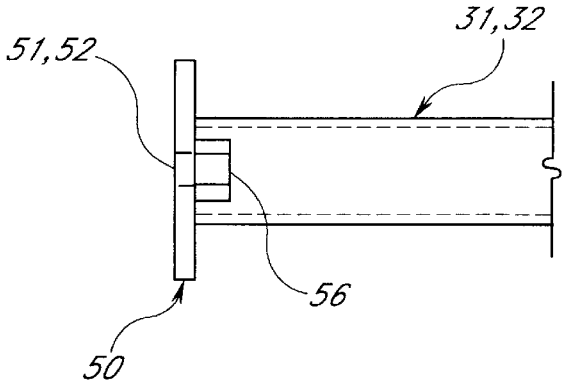
Figure 7:
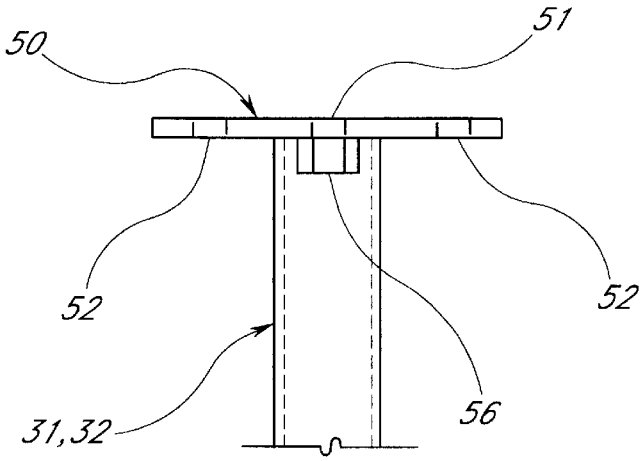

FIGS. 5–7 illustrate a first embodiment of the end connection device which is fixed and non-articulating. This embodiment is used to interconnect essentially parallel side surfaces of structural elements such as purlins 15. As can be seen in FIGS. 5–7, the non-articulating embodiment of the end connection device includes a base plate 50 having a central bolt hole 51 and a pair of flanking bolt holes 52. In addition, a plurality of fastener holes 54 are distributed in an appropriate pattern over base plate 50, e.g. at the approximate four corners thereof as shown in FIG. 5. Further, an optional threaded nut 56 may be provided for central bolt hole 51 for the purpose of allowing for a single bolt interconnection between load transferring devices in the manner described below. The distal end of pipe element 31 or 32 is secured about the center of base plate 50 using a structural connection, such as a structural weld.

In use, the embodiment 30 (FIG. 1) is first assembled by threading ends 36, 37 of pipe elements 31, 32 into ends 34, 35 of coupler 33. This assembly is then maneuvered into the space between parallel surfaces 16 of purlins 15, and adjusted in length by rotating coupler 33 With respect to pipe elements 31, 32. When the base plate 50 attached to the (distal end of each pipe element 31, 32 encounters the confronting side surface 16 of purlin 15, fasteners are installed in fastener holes 54, followed by the installation of bolts through bolt holes 51 or 52. In the case of a pipe element such as pipe element 31 terminating the load transfer connection at a purlin 15, bolt holes are drilled through the purlin 15 using the bolt holes 52 in base plate 50 as a template, and a suitable bolt 55 is passed through each bolt hole 52 and the through hole in purlin 15. The bolt is then secured at the other side of purlin 15 by means of a nut and thrust washer. In the case of a pipe element such as pipe element 32 which is connected to a purlin 15 having another load transfer device coupled to the other side thereof, the bolts are used to interconnect the two adjacent base plates of adjacent load transfer devices. When a pipe element is provided with optional threaded nut 56, two pipe elements on opposite sides of a building structural element such as purlin 15 may be interconnected by means of a single bolt 55 arranged through central bolt hole 51.

Figure 8:
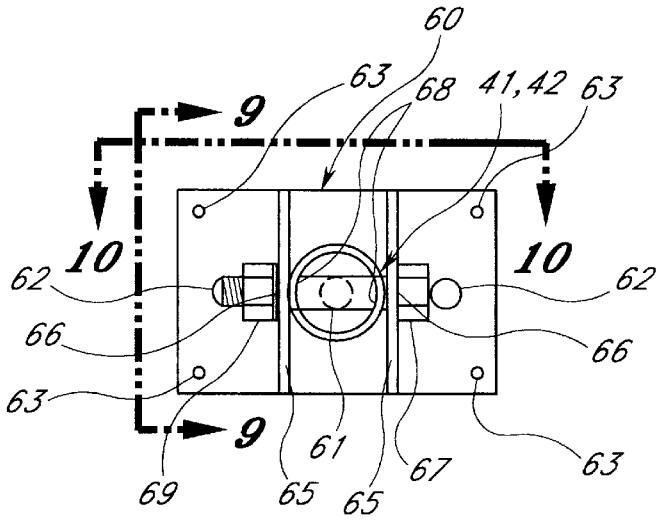
FIGS. 8–10 are a top plan view, side sectional view and front sectional view, respectively, of a second end connection device affording articulated movement in one plane.
Figure 9:
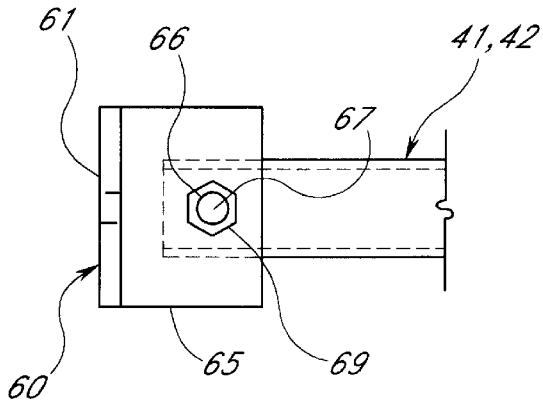
Figure 10:
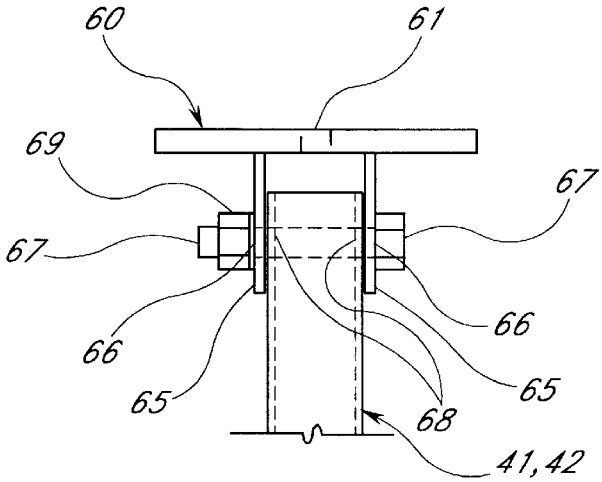
Figure 11:
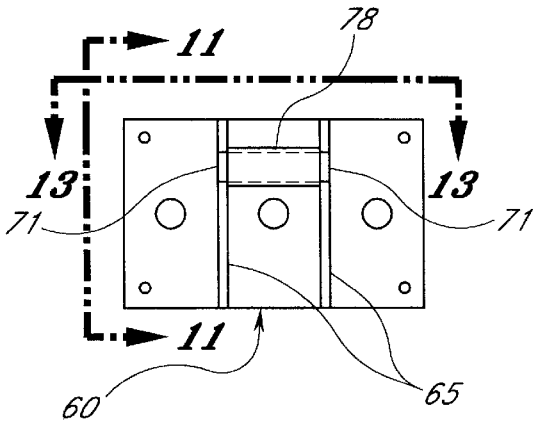
FIGS. 11–13 are a top plan view, side sectional view and front sectional view, respectively, of the connector plate and shim portion of another embodiment of the end connection device providing articulation and a lock-in feature.
Figure 12:
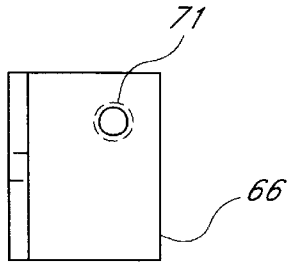
Figure 13:
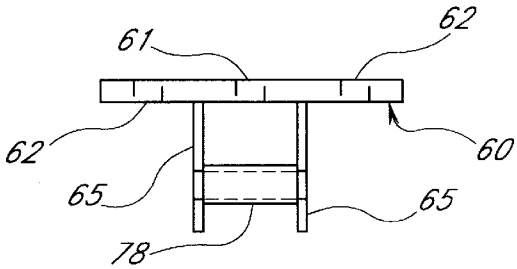
Figure 14:
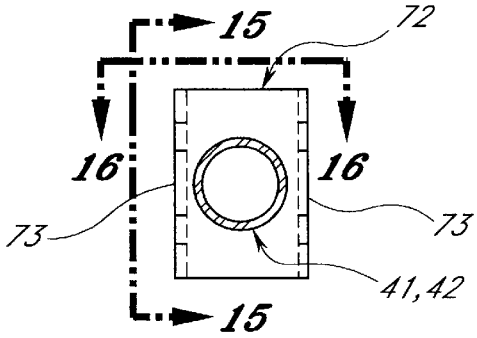
FIGS. 14–16 are a top plan view, side sectional view and front sectional view, respectively, of the U-plate portion of the embodiment partially illustrated in FIGS. 11–13.

FIGS. 8–10 illustrate a first version of the end connection devices providing articulation in one plane. The embodiment incorporating this end connection device is generally designated with reference numeral 40 in FIG. 1. As can be seen in FIGS. 8–10, this embodiment of the end connection device includes a base plate 60 having a central bolt hole 61 and a pair of flanking bolt holes 62. In addition, a plurality of fastener holes 63 are distributed in an appropriate pattern over base plate 60. Base plate 60 has a pair of connector plates 65 extending outwardly of one face thereof, and each connector plate 65 is provided with a pivot bolt aperture 66. A bolt 67 is received within the pivot bolt apertures 66 and pair of apertures 68 formed in the distal end of pipe elements 41, 42. Bolt 67 is secured in place by a nut 69.

In use, an end connection device of the type shown in FIGS. 8–10 is pivotally attached to the distal ends of pipe elements 41, 42 by maneuvering the distal end of one of the pipe elements 41, 42 into the space between connector plates 65 until the apertures 66, 68 align, installing a through bolt 67 through aligned apertures 66, 68 and securing the pivot bolt 67 in place with nut 69. Thereafter, installation of the embodiment 40 is accomplished in the same manner as that described above with reference to embodiment 30. In addition, as shown in FIG. 1 the end of embodiment 40 proximate to wall 12 is secured to ledger 14 and wall 12 by means of a bolt 21 received in a bolt hole bored through ledger 14 and wall 12, a thrust plate or washer 22 and a nut 23. As will be appreciated by those skilled in the art, embodiment 40 is particularly suitable for use in those applications in which the facing side surfaces of adjacent structural elements (e.g. ledger 14 and adjacent purlin 15) to which the base plates are to be attached do not lie in parallel planes. In such applications, the ability of the pipe elements 41, 42 to articulate with respect to the attached base members enables the device to be securely installed without the need for shims or other angular adjustment inserts. Embodiment 40 may also be used, if desired, for applications in which the facing side surfaces of the adjacent structural elements lie in parallel planes.

Figure 15:
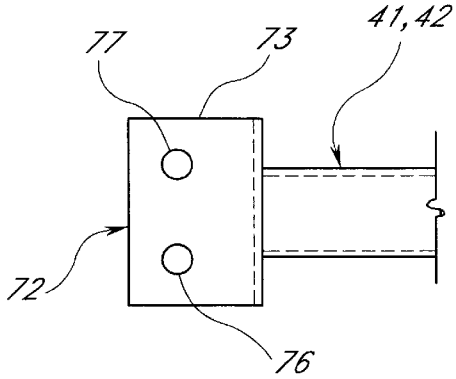
Figure 16:
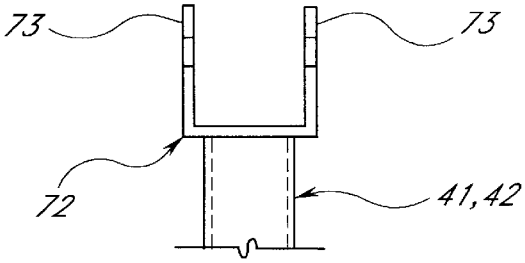

FIGS. 11–16 illustrate an end connection device providing articulation in one plane like the device of FIGS. 8–10, but which has an additional lock-in feature. In this embodiment, the centrally located bolt receiving apertures 66 in connector plates 65 are replaced by offset apertures 71. In addition, a U-shaped plate 72 is structurally secured to the distal end of pipe elements 41, 42, and the single through aperture 68 formed in the distal ends of pipe elements 41, 42 in the embodiment of FIGS. 8–10 is replaced by a pair of through apertures formed in the legs 73 of plate 72. As best shown in FIG. 15, each leg 73 of plate 72 is provided with a pair of apertures 76, 77, with upper aperture 77 used as the locating aperture for the pivot bolt 67. The other aperture 76 is used as a pilot hole for a locking bolt (not shown). In addition, a cylindrical shim spacer 78 having a length slightly less than the spacing between the facing surfaces of connector plates 65 is installed between these surfaces in alignment with apertures 71. In use, plate 72 is assembled to plate 60 in a manner identical to that described above for embodiment 40. After the device is installed in place, lock bolt apertures are formed in connector plates 65 by drilling using aperture 76 in legs 73 as a pilot hole. Thereafter, a lock bolt is installed in the lock bolt aperture and secured in place by a nut fastener. This embodiment provides additional rigidity to the connection, adding structural strength to the installation.

FIGS. 17–25 illustrate an end connection device providing articulation in two orthogonal planes. As can be seen in FIGS. 17–19, this embodiment of the end connection device includes a base plate 80 having a central bolt hole 81 and a pair of flanking bolt holes 82. In addition, a plurality of fastener holes 84 are distributed in an appropriate pattern over base plate 80. A first yoke structure generally designated with reference numeral 86 is centrally located about central bolt hole 81 and extends outwardly from surface 87 of base plate 80. First yoke structure 86 has a rectangular base portion 89 with flanking wall portions 90 each provided with a pivot bolt aperture 91. A second yoke structure generally designated with reference numeral 93 is structurally connected to the distal end of pipe elements 41, 42. Second yoke structure 93 is a U-shaped plate having tapered side legs 94 each provided with a pivot bolt aperture 95. First and second yoke structures 86, 93 are pivotally interconnected by means of a pivotal connector piece generally designated with reference numeral 100 which comprises a mounting plate 101 and a pair of hollow sleeves 102, 103 attached to plate 101 and arranged to be received within the flanking legs 90 of first yoke structure 86 and legs 94 of yoke structure 93, respectively.

In use, pivot sleeve 102 is maneuvered into the space between first yoke legs 90 until the interior of sleeve 102 aligns with pivot bolt apertures 91, and a suitable pivot bolt is installed and secured in place. Thereafter, pivot sleeve 103 is maneuvered into the space between second yoke legs 94 until the interior of sleeve 103 aligns with pivot bolt apertures 95, after which a suitable pivot bolt is installed and secured in place. As will be appreciated by those skilled in the art, this embodiment is particularly suitable for use in those applications in which the facing side surfaces of adjacent structural elements (e.g. ledger 14 and adjacent purlin 15) to which the base plates are to be attached form compound angles with one another.

As will now be apparent, load transferring devices fabricated according to the teachings of the invention are relatively easy to install between adjacent structural elements, while providing a precision installation. In particular, such devices require only initial assembly of the coupler, pipe elements and end connection devices, adjustment to provide the appropriate length to span the distance between the adjacent structural elements, installation of the fasteners and final installation of the mounting bolts through the bolt hole apertures and structural elements. In addition, installation of a series of load transfer devices with proper alignment is facilitated by the fact that the bolt holes in an installed load transfer device base plate serve as a template for forming the through holes in the structural member for alignment of the next load transfer device in sequence and also as a template for proper bolt fastener clearance on the connected structural member. This ensures that, once installed, any compression or tension forces experienced by a load transferring device connecting one building element to another, such as wall 12 and the roof diaphragm and framing system 13, Will be transferred axially via each load transfer device and through all intervening structural members, such as purlins 15. In addition, the use of the single or double articulating embodiments of the invention greatly facilitate installation and alignment for those applications in which the structural building members are mutually misaligned in one or more planes, or have irregularly shaped mounting surfaces.

While the above provides a full and complete disclosure of the preferred embodiments of the invention, various modifications, alternate constructions and equivalents will appear to those skilled in the art. For example, although connector plates 65 have been illustrated and described as extending in a direction normal to the surface of base plate 60, other relative angular arrangements may be employed, as desired. In addition, while connector plates 66 have been illustrated and described with rectilinear geometry, other geometries such as arcuate surface structures may be employed. Further, the invention can be installed between other building structural elements than those illustrated in the figures, such as between a parapet and a roof diaphragm and roof framing system (or some other building structural element). Therefore, the above descriptions and illustrations should not be construed as limiting the invention, which is defined by the appended claims.

What is claimed is:

1. A load transferring device for retrofitting between a pair of spaced building structural members, the load transferring device comprising:

an elongated load transfer element having an adjustable length between a first end and a second end;

a first end connection device articulately attached to the first end of the load transfer element, the first end connection device including a first base plate having an inner surface facing the first end and an outer surface for fastening to a first building structural member, the first end connection device further including a pair of spaced first connector plates extending from the first base plate, a first pivot bolt passing through each of the first connector plates and the first end of the load transfer element; and a second end connection device articulately attached to the second end of the load transfer element, the second end connection device including a second base plate having an inner surface facing the second end and an outer surface for fastening to a second building structural member, the second end connection device further including a pair of spaced second connector plates extending from the second base plate, a second pivot bolt passing through each of the second connector plates and the second end of the load transfer element, wherein a first lock-in aperture is provided in one of the pair of the second connector plates and the second end of the load transfer element, the first lock-in aperture serving as pilot hole for forming a second lock-in aperture in another one of the pair of second connector plates and the load transfer element and to serve as an aperture for receiving a lock bolt after the pivot bolt is installed in the pivot bolt apertures, thereby preventing articulation between the second end connection device and the load transfer element.

2. A load transferring device for retrofitting between a pair of spaced building structural members, the load transferring device comprising:

an elongated load transfer element having an adjustable length between a first end and a second end;

a first end connection device articulately attached to the first end of the load transfer element, the first end connection device including a first base plate having an inner surface facing the first end and an outer surface for fastening to a first building structural member, the first end connection device further including a pair of spaced first connector plates extending from the first base plate, a first pivot bolt passing through each of the first connector plates and the first end of the load transfer element, wherein each first connector plate has a pivot bolt aperture, a pair of spaced first connector legs secured to the first end of the load transfer element, each first connector leg having a pivot bolt aperture, the relative spacing between the connector plates and the connector legs enabling one pair to be received within the other pair, the first pivot bolt received within the pivot bolt apertures to provide an articulating connection; and a second end connection device articulately attached to the second end of the load transfer element, the second end connection device including a second base plate having an inner surface facing the second end and an outer surface for fastening to a second building structural member, the second end connection device further including a pair of spaced second connector plates extending from the second base plate, a second pivot bolt passing through each of the second connector plates and the second end of the load transfer element.

3. The device of claim 2 further including a pivot connector piece having a first pivot guide for alignment with the connector plate pivot bolt apertures and a second pivot guide for alignment with the connector leg pivot bolt apertures, the first and second pivot guides being arranged at an angle with respect to each other to provide a two-axis articulating connection.

4. A load transferring device for retrofitting between a pair of spaced building structural members, the load transferring device comprising:

an elongated load transfer element having an adjustable length between a first end and a second end, the load transfer element comprising a pair of aligned load transfer members and an adjustable connection between the pair of load transfer members, each of the load transfer members having a substantially cylindrical cross-section, at least one of the load transfer members having an inner end threadingly connected to an intervening coupler member, wherein the inner ends of the pair of load transfer members have external threads and the coupler member has internal threads;

a first end connection device articulately attached to the first end of the load transfer element, the first end connection device including a first base plate having an inner surface facing the first end and an outer surface for fastening to a first building structural member, the first end connection device further including a pair of spaced first connector plates extending from the first base plate, a first pivot bolt passing through each of the first connector plates and the first end of the load transfer element; and a second end connection device articulately attached to the second end of the load transfer element, the second end connection device including a second base plate having an inner surface facing the second end and an outer surface for fastening to a second building structural member, the second end connection device further including a pair of spaced second connector plates extending from the second base plate, a second pivot bolt passing through each of the second connector plates and the second end of the load transfer element.

5. The device of claim 4 wherein each of the first and second base plates includes a first plurality of fastener apertures.

6. A load transferring device for retrofitting between a pair of spaced building structural members, the load transferring device comprising:

an elongated load transfer element having an adjustable length between a first end and a second end;

a first end connection device articulately attached to the first end of the load transfer element, the first end connection device including a first base plate having an inner surface facing the first end and an outer surface for fastening to a first building structural member, the first end connection device further including a pair of spaced first connector plates extending from the first base plate, a first pivot bolt passing through each of the first connector plates and the first end of the load transfer element; and a second end connection device articulately attached to the second end of the load transfer element, the second end connection device including a second base plate having an inner surface facing the second end and an outer surface for fastening to a second building structural member, the second end connection device further including a pair of spaced second connector plates extending from the second base plate, a second pivot bolt passing through each of the second connector plates and the second end of the load transfer element, wherein the second end connection device includes a pivot locking mechanism fixing the second base plate non-rotatably relative to the second end of the load transfer element.

* * * * *